US011988487B2

(12) United States Patent
Peterman

(10) Patent No.: US 11,988,487 B2
(45) Date of Patent: May 21, 2024

(54) SELF-HEALING TARGET WITH AUDIBLE AND KINETIC RESPONSE

(71) Applicant: Saros Industries, LLC, Troy, MO (US)

(72) Inventor: John M. Peterman, Troy, MO (US)

(73) Assignee: GPRE IP, LLC, St. Louis, RI (US)

( * ) Notice: Subject to any disclaimer, the term of this patent is extended or adjusted under 35 U.S.C. 154(b) by 0 days.

(21) Appl. No.: 17/543,423

(22) Filed: Dec. 6, 2021

(65) Prior Publication Data

US 2022/0178660 A1 Jun. 9, 2022

Related U.S. Application Data

(60) Provisional application No. 63/121,575, filed on Dec. 4, 2020.

(51) Int. Cl.

| | |
|---|---|
| ***F41J 1/01*** | (2006.01) |
| ***F41J 1/10*** | (2006.01) |
| ***F41J 5/06*** | (2006.01) |
| ***F41J 7/04*** | (2006.01) |

(52) U.S. Cl.

CPC . *F41J 1/01* (2013.01); *F41J 1/10* (2013.01); *F41J 5/06* (2013.01); *F41J 7/04* (2013.01)

(58) Field of Classification Search

CPC . F41J 1/00; F41J 1/01; F41J 5/06; F41J 5/24; F41J 7/04; F41J 13/00; F41J 1/10

See application file for complete search history.

(56) References Cited

U.S. PATENT DOCUMENTS

| | | | | |
|---|---|---|---|---|
| 4,773,653 | A * | 9/1988 | Unverzagt | F41J 13/00 273/408 |
| 4,819,946 | A * | 4/1989 | Kahler | F41J 13/00 273/404 |
| 9,927,216 | B2 * | 3/2018 | Anderson | F41J 7/04 |
| 2015/0330748 | A1 * | 11/2015 | Anzalone | F41J 1/10 273/390 |
| 2017/0336179 | A1 * | 11/2017 | Brune | F41J 5/24 |
| 2021/0148680 | A1 * | 5/2021 | Blackwood | F41J 13/02 |

OTHER PUBLICATIONS

Linatex Rubber Products, Target Backing, Technical Specifications, Weir Minerals, (C) 2016 (Year: 2016).*

* cited by examiner

*Primary Examiner* — Laura Davison

(74) *Attorney, Agent, or Firm* — Douglas D. Churovich, Esq.; Churovich Law, LLC

(57) ABSTRACT

An audible response self-healing target having a generally flat shell mated with a generally flat metal strike plate. The shell has a "self-healing" polymer "target zone", and tabs that hold the metal plate parallel to the target zone with a small gap of approximately one-half inch. The shell rotatably mounts onto a pole, such that when a projectile, such as a bullet slug, impacts the target's strike zone, the slug penetrates the polymer and strikes the metal plate, kinetically causing the target to rotate about the pole and also causing the metal plate to generate an audible response.

20 Claims, 6 Drawing Sheets

SELF-HEALING TARGET WITH AUDIBLE AND KINETIC RESPONSE

CROSS REFERENCE TO RELATED APPLICATIONS

This application derives and claims priority from U.S. provisional application 63/121,575 filed 4 Dec. 2020, which application is incorporated herein by reference.

STATEMENT REGARDING FEDERALLY SPONSORED RESEARCH OR DEVELOPMENT

Not applicable.

BACKGROUND OF THE INVENTION

This invention relates principally to projectile targets constructed with self-healing polymers, and more particularly to a self-healing shooting target that produces an audible and kinetic response when struck by a bullet slug or other projectile, and which captures the slug to minimize the chance of ricochet.

What is commonly known in the firearms industry as a "self-healing" target is a target that is constructed with a an elastic polymer that can be penetrated by a bullet slug and then due to the plasticity of the polymer, the target will reform to its original shape after such penetration. That is, a bullet hole in the target will close or "self-heal" on its own without aid or assistance. This is due to the particular polymers used in the construction of the target. As the bullet slug passes through the polymeric material, the friction and heat created by the slug is absorbed by the material surrounding the penetration path. The polymeric material reacts by contracting and closing the path through the material. Further, these features of "self-healing" targets also substantially slow, or even stop, the progress of a bullet slug passing through the polymer. Although self-healing targets can vary considerably in size, shape, material type, each may be able to absorb thousands of strikes before serious degradation requires replacement.

Further, competition shooters sometimes fire at their target at close range in a rapid movement, which exposes the shooter to ricochets if a steel target is being used. The self-healing polymer targets are soft enough to minimize the chance that a bullet slug will ricochet and endanger the shooter when firing at close range. Thus, self-healing targets provide the opportunity for close-in target practice.

For these reasons, self-healing targets have recently gained popularity in the sporting market. Such self-healing targets are marketed in a wide variety of target constructs, including for example, "gong" (i.e., audible) and spinning (i.e., kinetic) targets. It is not uncommon for self-healing targets to be designed with the polymeric material layered over or forming a coating on top of a rigid material, such as for example wood, rigid plastic, or a metal such as steel. This enables the target to form and retain a desired shape while still providing the benefits of the target's self-healing polymers.

However, traditional steel-backed targets do not allow the bullet slug to pass through the self-healing target. Rather, the bullet slug will likely get stuck in the target. A bullet slug stuck in the target held in place by the polymer can cause a ricochet if struck by another projectile, endangering or injured the shooter.

In addition, the kinetic energy from a bullet slug impacting a traditional self-healing" polymer target can be absorbed by the target in such a way that the target will not display a visual movement to indicate the strike. Also, the sound of the bullet slug hitting a traditional "self-healing" polymer target can be drowned out by the firing/discharging of the firearm. This condition can be complicated in certain forms of multi-target competition shooting, for example when competition shooters fire very fast and look to a visual movement of the target, as opposed to a sound response, to cue the shooter to move to the next target.

Further, self-healing polymers act as sound dampening agents. As a consequence, the polymers will produce little, if any, sound when struck by a bullet slug. Moreover, even when the targets are constructed with rigid materials that would otherwise generate an audible response when struck by a bullet slug, the polymers coating the rigid materials muffle or entirely eliminate any such sound from being generated by the target. Moreover, self-healing targets that comprise a polymer over a rigid backing, such as steel, may still result in a ricocheted slug when struck.

Because an audible response is a very desirable feature of shooting targets, it would therefore be desirable to have a kinetic self-healing target that is capable of producing an audible response that can be readily heard by a user shooting at the target. In addition, because ricocheting slugs can pose a serious safety hazard, it would be desirable to have a kinetic self-healing target configured to minimize or eliminate the potential for ricochets. As will become evident in this disclosure, the present invention provides such benefits over the existing art.

BRIEF DESCRIPTION OF THE DRAWINGS

The illustrative embodiments of the present invention are shown in the following drawings which form a part of the specification.

Corresponding reference characters indicate corresponding parts throughout the several views of the drawings.

DETAILED DESCRIPTION

Figure 1:
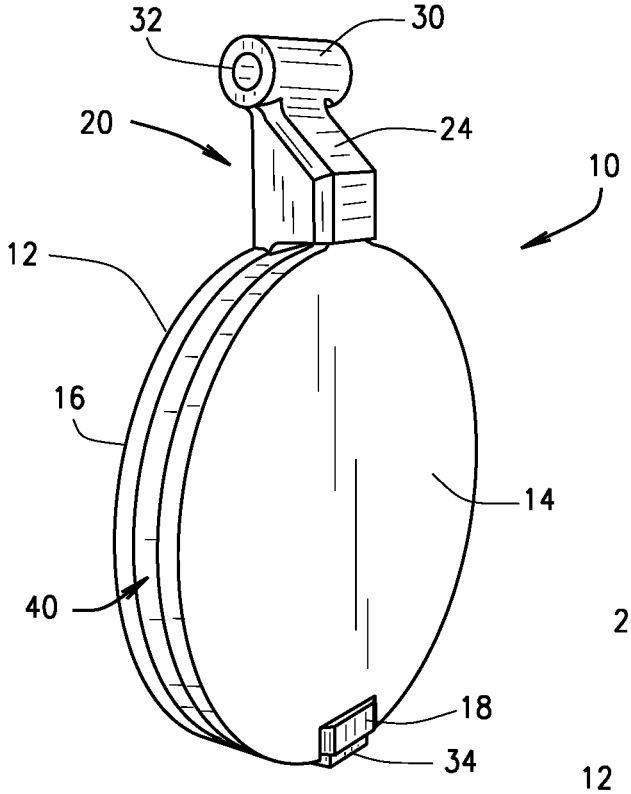
FIG. 1 is a rear perspective view of a single direction kinetic spin target incorporating a first representative embodiment of the present invention.
Figure 2:
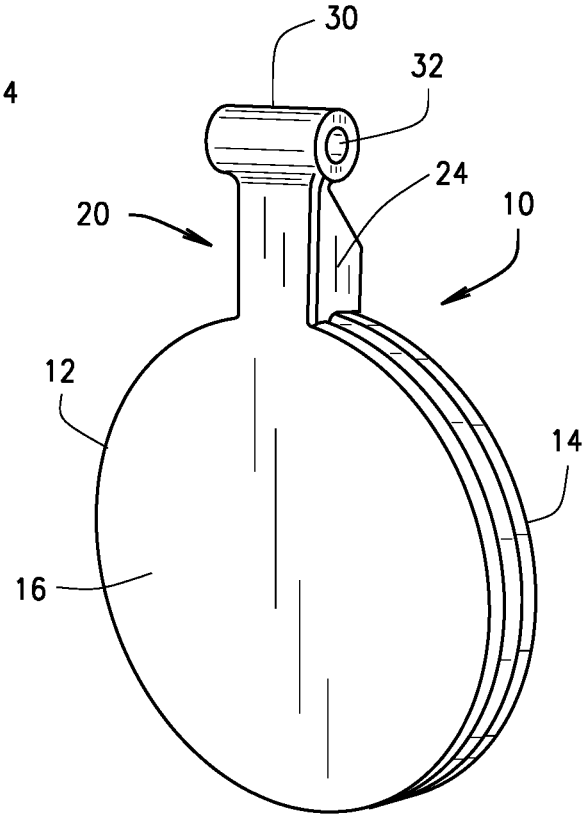
FIG. 2 is a front perspective view of the target of FIG. 1.

In referring to the drawings, the novel self-healing kinetic target with audible response of the present invention is depicted by way of example as the single direction kinetic spin target 10. As can be seen from FIGS. 1-4, the target 10 has a front polymer body or shell 12 which holds securing a matching metal strike plate 14. The strike plate 14 is constructed of steel, or some other durable and rigid audible-producing material. The shell 12 is formed from a "self-healing" or "ballistic" polymer that allows projectiles, and in particular bullet slugs, to penetrate the target and then reclose the opening or rupture in the polymer opened by the projectile after the projectile has exited the opening or rupture. Various polymers can be used for this purpose and are well-known in the art, such as for example, a polyurea formed from a mixture of approximately one part isocyanate to approximately an equal one part polyetheramine.

The shell 12 has a flat and circular central polymer strike zone or target plate 16, a lower attachment member or tab 18, and an upper attachment structure 20. The target plate 16 has a diameter of approximately six inches and a thickness of approximately one-quarter inch. The lower attachment tab 18 is generally rectangular, approximately one inch wide, and extends approximately three-quarters of an inch perpendicularly rearward from the lower edge of the back face of target plate 16. The attachment structure 20 is approximately one inch wide and two to three inches long.

Figure 4:
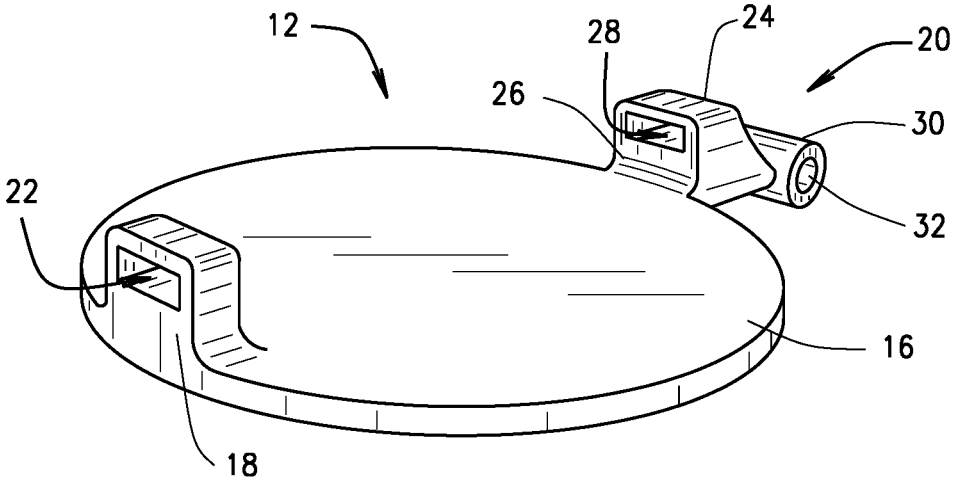
FIG. 4 is a perspective view of the polymer body or shell with associated attachment features of the target of FIG. 1.

Referring to FIG. 4, it can be seen that the tab 18 has a vertical through-slot 22 that extends horizontally across the central portion of the tab 18 generally parallel to the polymer target plate 16. The slot 22 is approximately one-quarter inch wide and one-half inch long. At the other end of the polymer shell 12, the attachment structure 20 extends radially outward approximately two inches from the edge of the target plate 16 opposite the tab 18. The attachment structure 20 has a central portion 24 that projects rearward in a trapezoidal fashion with a flat, generally rectangular face 26 that abuts and is perpendicular to the target plate 16 and faces toward the tab 18. A slot 28 is formed in the face 26 that extends horizontally across the central portion of the face 26 generally parallel to the target plate 16. The slot 28 is approximately one-quarter inch wide and one-half inch long, and extends into the central portion approximately one-half inch.

The attachment structure 20 also has a horizontal cylindrical tube 30 that runs along the outermost edge of the central portion 24 opposite the target plate 16. The cylindrical tube 30 has a central bore 32 that is approximately one-half inch in diameter, and approximately one inch long. The cylindrical tube 30 and its central bore 32 are both generally coplanar with the target plate 16 but run perpendicular to the perimeter of the target plate 16. As can be appreciated by one skilled in the art, the cylindrical tube 30 is configured for rotatable attachment to a support structure such as for example a rod or pole (not shown) such that the target 10 can be held in position by the rod or pole for target practice, yet is free to rotate about the rod or pole when struck by a projectile such as a bullet slug.

Figure 3:
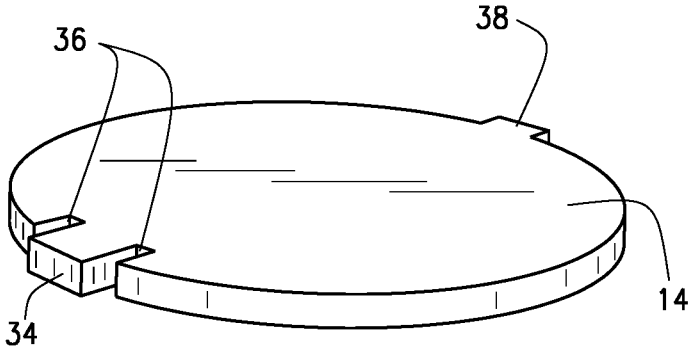
FIG. 3 is a perspective view of the metal plate of the target of FIG. 1.

Referring to FIG. 3, it can be seen that the metal strike plate 14, which is preferably constructed of a hardened steel that will not appreciably distort when struck by a bullet slug, has a diameter of approximately six inches, a thickness of approximately one-quarter inch, and generally matches the shape of the polymer target plate 16. However, the metal strike plate 14 has at one end an attachment member or tab 38 that extends radially outward from the metal strike plate 14, as well as a pair of slots 36 cut into the strike plate 14 that define the sides of an attachment member or tab 34. The tabs 34 and 38 are coplanar and colinear.

The tab 34 has a width of approximately three-quarters inch, an overall length of approximately three-quarters inch, and extends approximately one-quarter inch beyond the radiused edge of the metal strike plate 14. Tab 38 extends in the opposite direction from the opposite side of the metal plate 14, and shares the same width of three-quarter inch. However, unlike the tab 34, the tab 38 has no adjoining slots (such as the slots 36). Rather, the tab 38 simply extends approximately one-quarter inch beyond the radiused edge of the metal strike plate 14.

Referring again to FIGS. 1-4, it can readily understood that the tabs 34 and 38 on the metal strike plate 14, are shaped and sized to slip snugly, yet releasably, into the slots 22 and 28, respectively in the polymer shell 12. It can therefore be appreciated, and as depicted in the Figures, that in this way, the metal strike plate 14 can be releasably secured in the polymer shell 12 such that the metal strike plate 14 is positioned parallel to the polymer target plate 16, but separated by a generally uniform separation or air gap 40, of approximately one-half inch.

Both of the slots 22 and 28 in the polymer are separated from the plane of the target plate 16 by approximately one-half inch. As can be appreciated, this separation between the slots 22 and 28, and the target plate 16, defines the separation or air gap 40 between the polymer target plate 16 of the shell 12 and the metal strike plate 14.

A second configuration of the present invention is shown at 100 in FIGS. 5-9. In this second embodiment, the target 100 has two opposing, parallel outer polymer target bodies or shells 112 and 112A that envelop a centrally-positioned rigid circular metal strike plate 114 having a diameter of approximately six inches and a thickness of approximately one-quarter inch. The shells 112 and 112A both have the same configuration, and are both formed from a "self-healing" polymer that allows projectiles, and in particular bullet slugs, to penetrate the target and then reclose the opening or rupture in the polymer opened by the projectile. Here again, the flat plates 116 and 116A of each of the polymer shells 112 and 112A are separated from the metal strike plate 114 by uniform separations or gaps 140 and 140A of approximately one-half inch each.

Each of the shells 112 and 112A has an inner attachment member or tab 120 and 118A, respectively, and an outer attachment member or tab 118 and 120A, respectively, opposite their respective inner tabs 120 and 118A. Each of the tabs 118, 118A and 120, 120A is generally flat and rectangular, approximately one inch wide, approximately one-quarter inch thick, and extends approximately three-quarters of an inch perpendicularly upward from the inner face of its respective target plate 116 or 116A. The tabs 118, 118A and 120, 120A are substantially parallel to each other. However, outer tabs 118 and 120A each extend upward from a chord near the perimeter of their respective target plates 116 and 116A, while inner tabs 120 and 118A each extend upward from a chord approximately one quarter inch inward from the perimeter of their respective target plates 116 and 116A.

Figure 7:
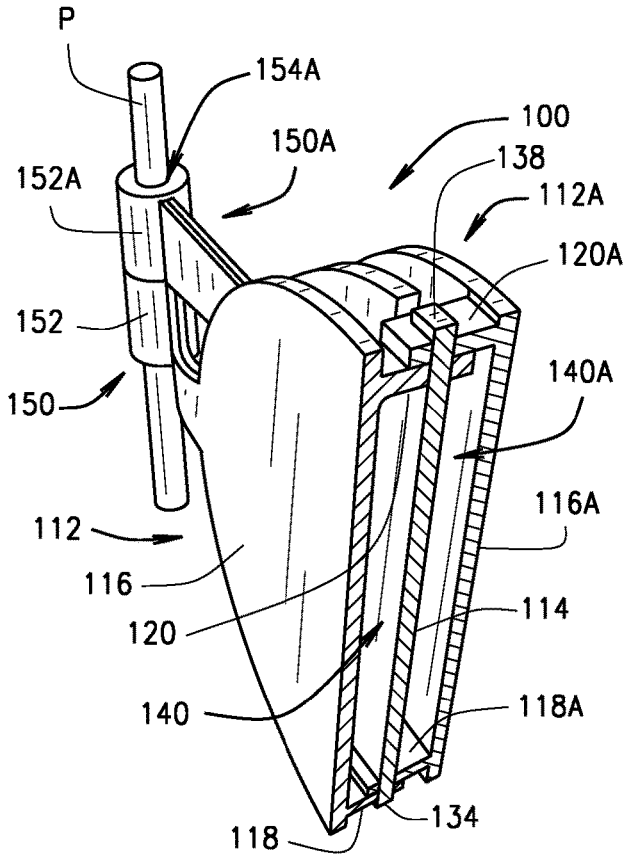
FIG. 7 is a cross-sectional perspective view of the target of FIG. 5.

Referring particularly to FIG. 7, it can be seen that each of the tabs 118 and 120 have matching through-slots 122 that extend horizontally through the central portion of the tabs 118 and 120, generally parallel to the polymer target plate 116, 116A. The slots 122 are approximately one-quarter inch tall and one-half inch across.

The shells 112 and 112A each have an attachment structure 150, 150A, that extends outward from its respective target plate 116, 116A. The attachment structure extends generally along a line parallel to, but slightly off-center of, a radius of the target plate 116, 116A. Further, the attachment structures 150, 150A extend outward in a generally coplanar manner from their respective target plates 116, 116A, for approximately one inch, then bend inward at an angle $\alpha$ of approximately 5 degrees to extend further to their respective cylindrical tubes 152, 152A. The angle $\alpha$ and the lengths of each portion of the attachment structures 150, 150A are configured such that as shown in FIGS. 5 and 7, the shells 112 and 112A can be positioned to face each other while joined together, and properly assembled, by a support structure such as for example a single rod or pole, such as a pole P shown (which is not a component of the target 100).

Each of the attachment structures 150 and 150A has a horizontal cylindrical tube 152, 152A that runs along the outermost edge of its corresponding attachment structure 150, 150A, opposite the target plate 116, 116A. Each cylindrical tubes 152 and 152A, has a corresponding central bore 154, 154A, that is approximately one-half inch in diameter, and approximately one inch long. The cylindrical tubes 152 and 152A, and their central bores 154 and 154A, both run generally perpendicular to the perimeter of the target plates 116, 116A, and when the target 100 is assembled, the cylindrical tubes 152 and 152A, and their central bores 154 and 154A are coaxial. As can be appreciated by one skilled in the art, the cylindrical tubes 152 and 152A are configured for rotatable attachment to a rod or pole, such as for example, the pole P, such that the target 100 can be held in position by the pole P for target practice, yet is free to rotate about the pole P when struck by a projectile such as a bullet slug.

Figure 9:
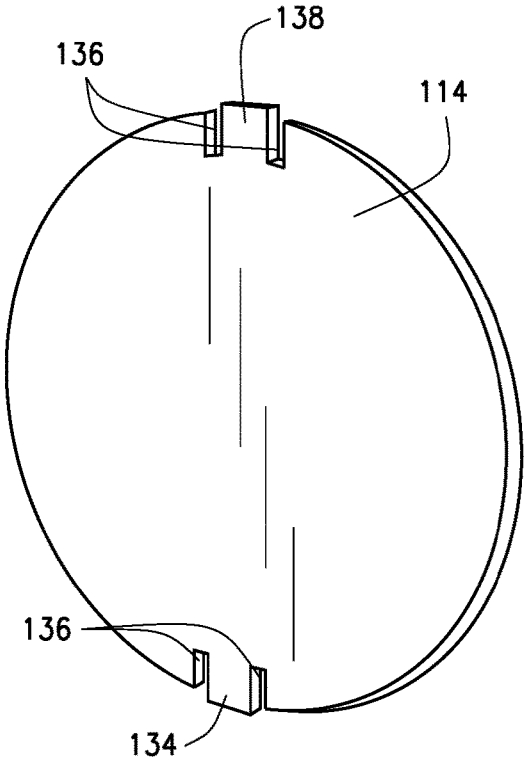
FIG. 9 is a perspective view of the metal plate of the target of FIG. 5.
Figure 8:
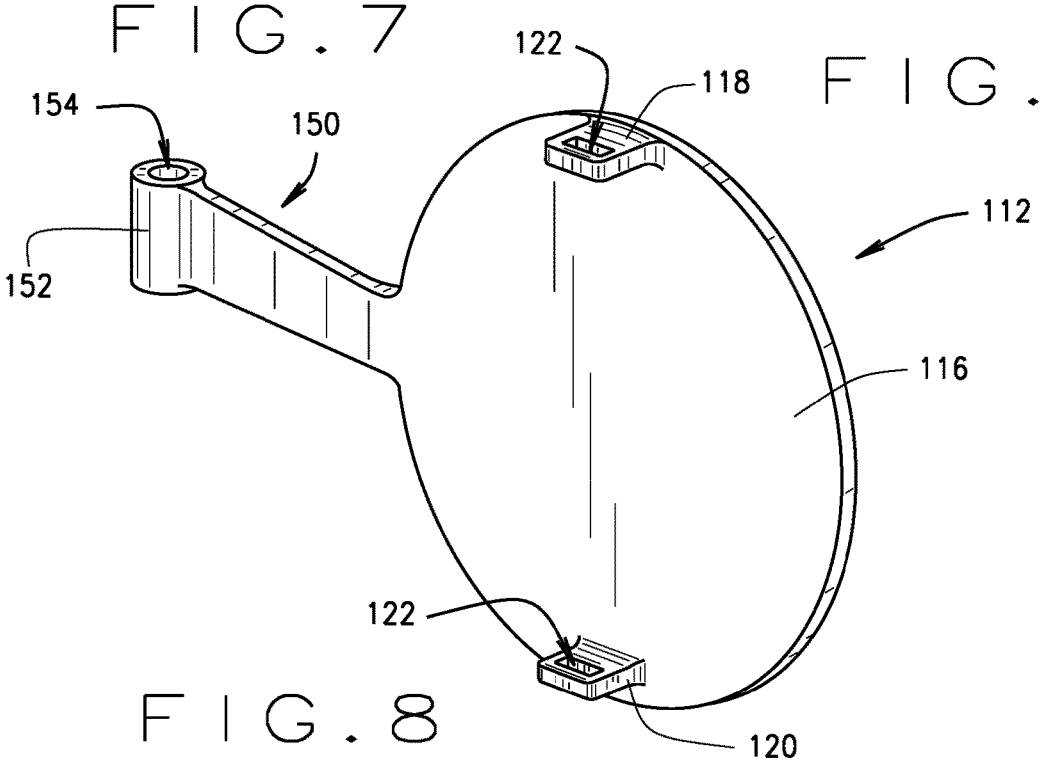
FIG. 8 is a perspective view of one of the polymer bodies with associated attachment features of the target of FIG. 5.

Unlike the target 10, in which only one of the two tabs 34, 38 of metal strike plate 14 has side slots 36 (FIG. 3), the target 100's metal strike plate 114 has two opposing tabs, 134 and 138, each having a set of parallel slots 136 positioned along each side of the tab (FIG. 9). Each of the tabs 134 and 138 has an overall length of approximately three-quarter inch, a width of approximately one-half inch, and extend radially outward from the strike plate 114 approximately one-quarter inch.

Figure 5:
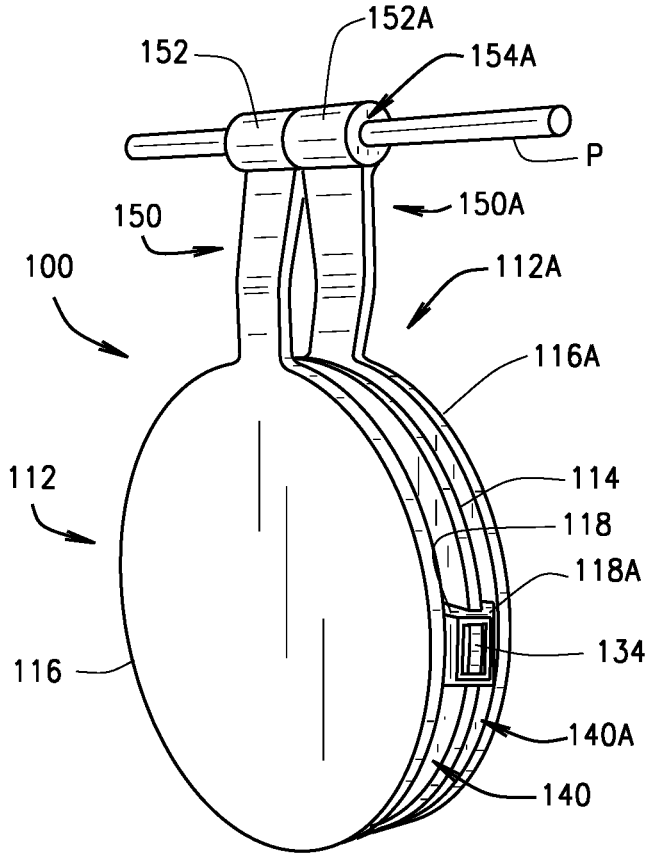
FIG. 5 is a perspective view of a double direction kinetic spin target incorporating a second representative embodiment of the present invention.
Figure 6:
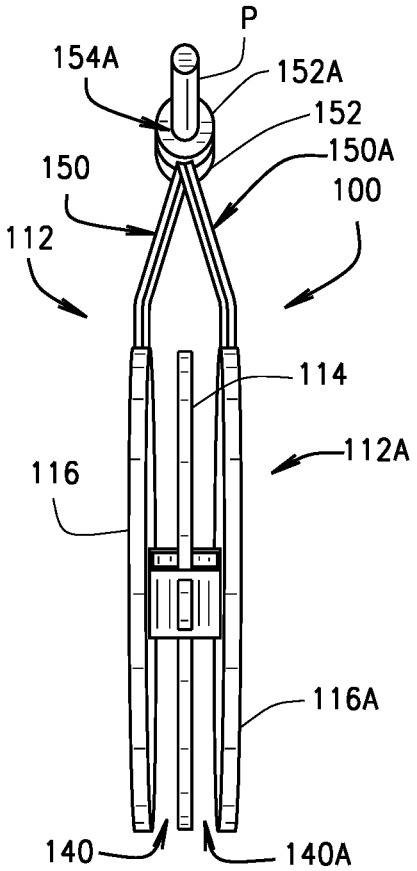
FIG. 6 is a side view of the target of FIG. 5.

As can be appreciated, and as shown in FIGS. 5-7, the tabs 134 and 138 on strike plate 114 are shaped and sized to slip snugly, yet releasably, into the slots 122 in the polymer shells 112 and 112A. Yet, in addition, as can be further seen, outer tabs 118 and 120A are positioned relative to inner tabs 120 and 118A such that when the target 100 is properly assembled (as shown in FIGS. 5-7), the outer tabs 118 and 120A will overlap their respective counterpart inner tabs 120 and 118A (see particularly FIG. 7). In this way, the tab 134 can be simultaneously inserted into both tabs 118 and 118A at one end of the target 100, while the tab 138 can be simultaneously inserted into both tabs 120 and 120A at the opposite end of the target 100.

All of the slots 122 in the polymer are separated from the plane of the target plates 116 and 116A by approximately one-half inch. As can be appreciated, this separation between the slots 122 and the target plates 116 and 116A, defines the separation or air gaps 140 and 140A between the polymer target plates 116 and 116A of the shells 112 and 112A, and the metal strike plate 114.

It can therefore be appreciated, and as depicted in the Figures, that in this way, the metal strike plate 114 can be releasably secured in the polymer shell 112, 112A such that the metal strike plate 114 is positioned parallel to the polymer target plate 116, but separated by a generally uniform separation or air gap 140, of approximately one-half inch, and at the same time the metal strike plate 114 is positioned parallel to the polymer target plate 116A, but separated by a generally uniform separation or air gap 140A, of approximately one-half inch.

In order to rotatably mount the target 100 to a rod or pole such as the pole P, each of the shells 112 and 112A has an attachment arm 150, 150A that projects from the side of the shells 112 and 112A, respectively, at a position approximately 90 degrees in rotation from the tabs 118 and 120 along the perimeter of the shells 112 and 112A. As can be appreciated, when the target 100 is properly mounted on a rod or pole, such as the pole P, is struck by a projectile, such as a bullet slug, the target 100 will rotate about the pole P to which it is attached due to the kinetic energy it absorbs from the force of the projectile's impact.

As can also be appreciated upon seeing this disclosure, one of ordinary skill in the art would understand that the separation between the metal strike plate 14 and the polymer target plate 16, and the separation between the metal strike plate 114 and the polymer target plates 116 and/or 116A, allows the target 10, 100 to generate a substantial audible response when a projectile directed at the target passes through the "self-healing" polymer of the target plate 16, 116 or 116A and strikes the metal strike plate 14 or 114. This contrasts with the highly muffled and nearly inaudible response encountered when shooting a projectile at a traditional "self-healing" target where the polymer has no metal backing or is positioned against or forms a coating over any rigid structural component in the target.

Figure 12:
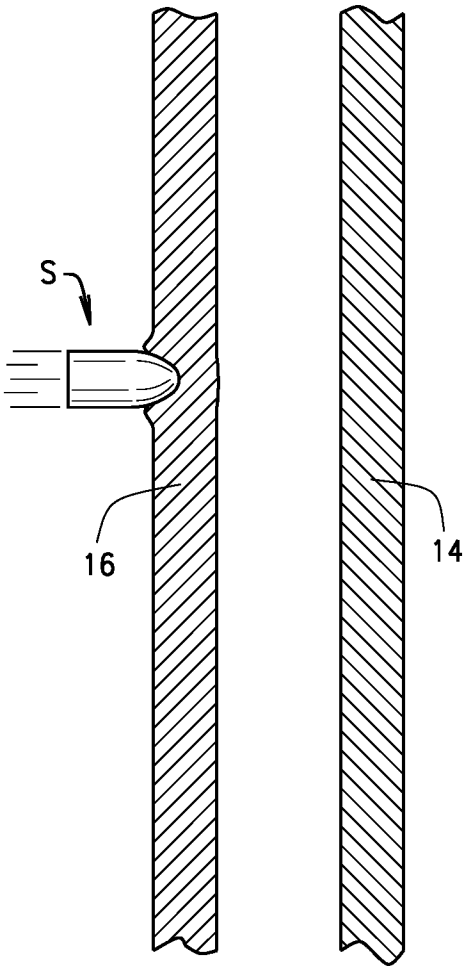
FIG. 12 is the cross-sectional view of FIG. 11, in which the bullet slug is beginning to penetrate and form a rupture in the polymer plate.
Figure 11:
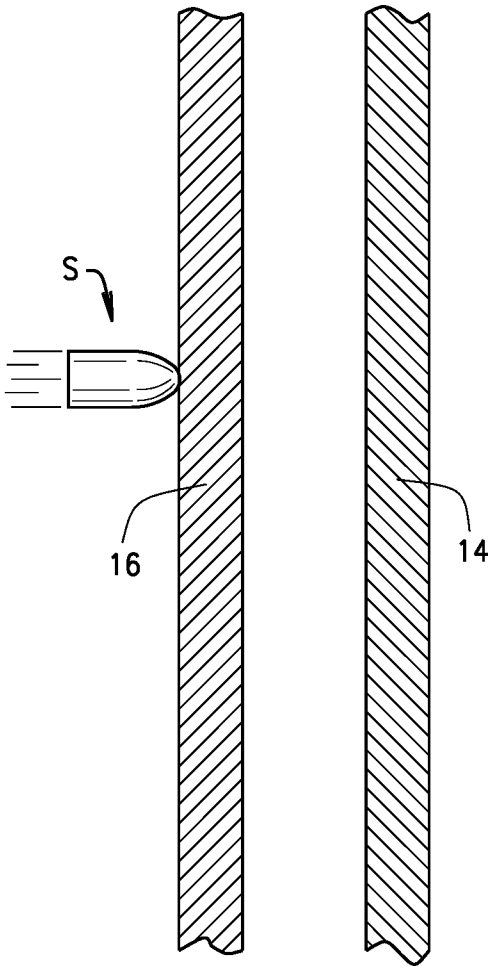
FIG. 11 is the cross-sectional view of FIG. 10, in which the bullet slug is making initial contact with the polymer plate.
Figure 10:
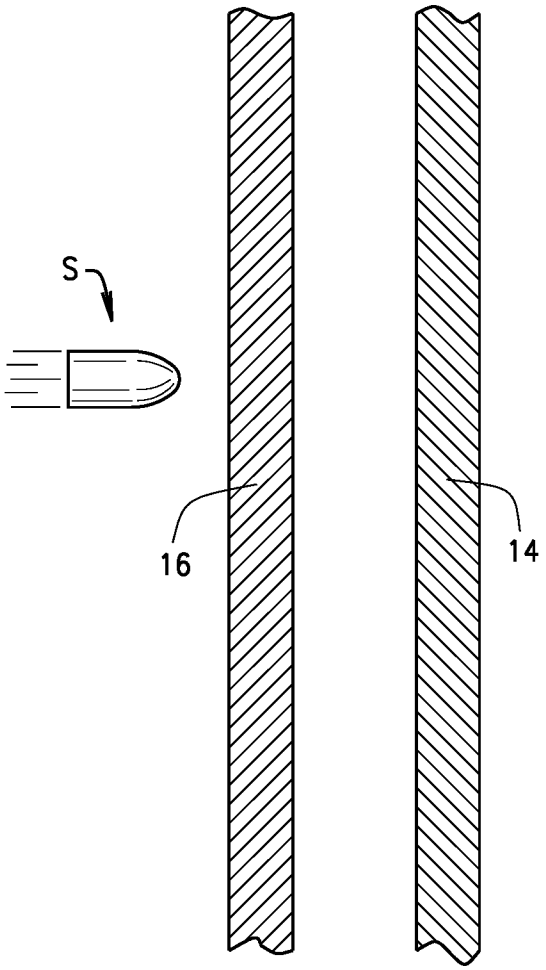
FIG. 10 is a cross-sectional view of a central portion of the target of FIG. 1, depicting a bullet slug fired from a firearm approaching the polymer plate.
Figure 15:
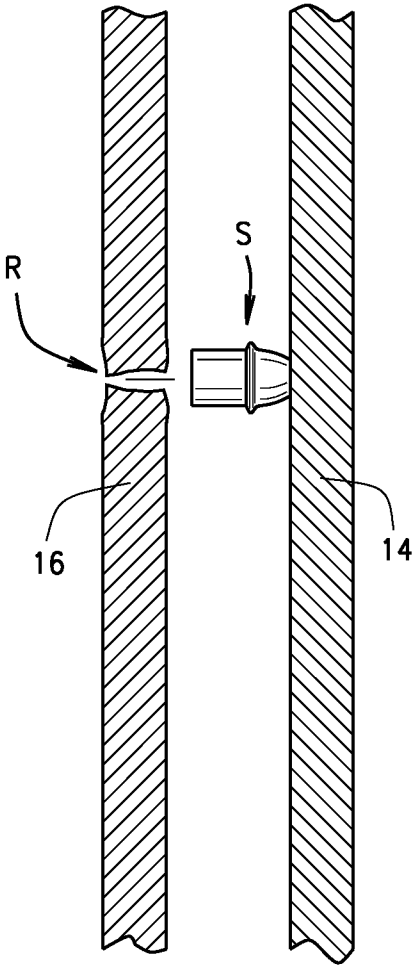
FIG. 15 is the cross-sectional view of FIG. 14, in which the bullet slug is beginning to deform as it impacts the metal plate, while the polymer plate begins to "self-heal" and close the rupture.
Figure 14:
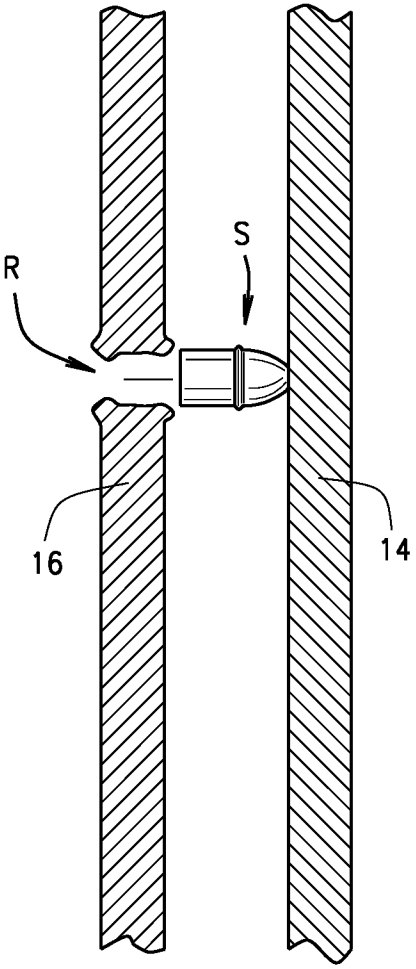
FIG. 14 is the cross-sectional view of FIG. 13, in which the bullet slug has fully passed through the polymer plate and is making initial contact with the metal plate, leaving behind a full rupture of the polymer plate.
Figure 13:
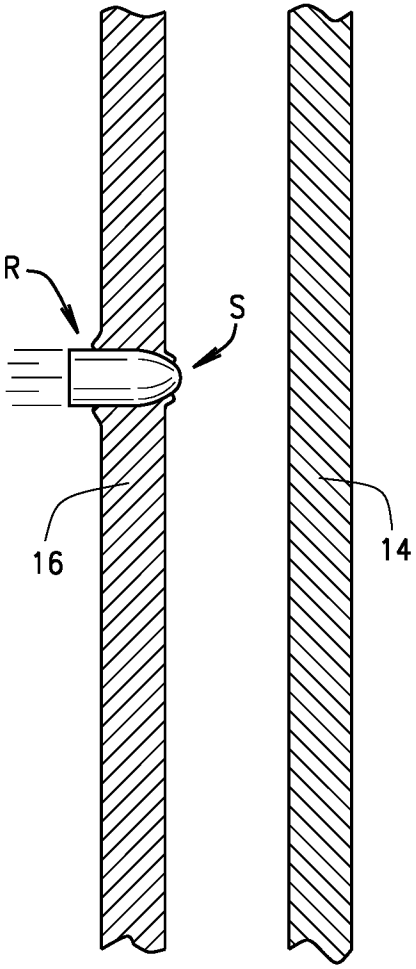
FIG. 13 is the cross-sectional view of FIG. 12, in which the bullet slug has fully penetrated the polymer plate, causing a full rupture of the polymer plate.
Figure 18:
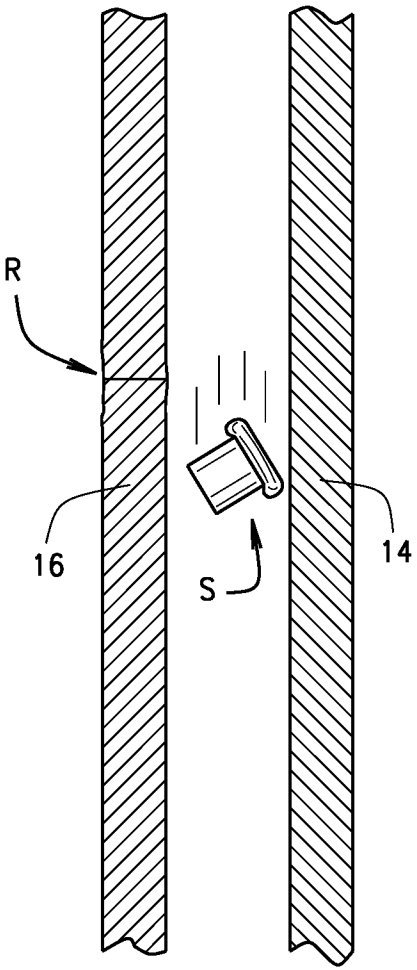
FIG. 18 is the cross-sectional view of FIG. 17, in which the deformed bullet slug is dropping out of the target between the polymer and steel plates.
Figure 17:
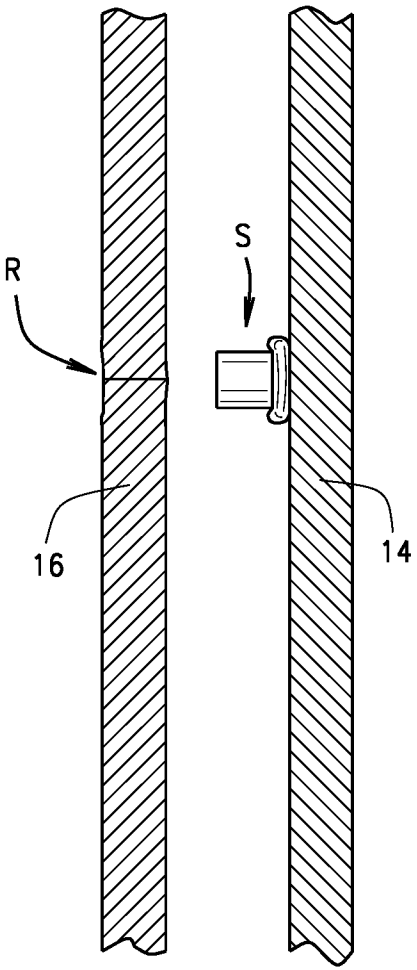
FIG. 17 is the cross-sectional view of FIG. 16, in which the bullet slug continues to deform as it further impacts the metal plate.
Figure 16:
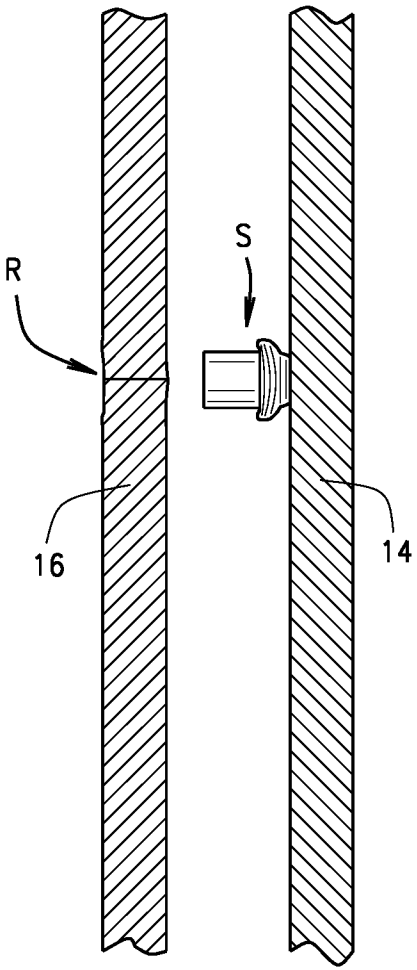
FIG. 16 is the cross-sectional view of FIG. 15, in which the bullet slug continuing to deform as it further impacts the metal plate, while the polymer has "self-healed" and fully closed the rupture.

Further, and referring now to FIGS. 10-18, it can be seen that when a bullet slug, such as the slug S depicted, strikes a target 10 or 100 constructed in accordance with the present disclosure (FIGS. 10-12), the slug S will penetrate the polymer target plate 16, 116 or 116A and create an opening or rupture R in its wake (FIGS. 12-14). However, after the bullet slug S passes through the target plate 16, 116 or 116A (FIGS. 14-15), the polymer immediately begins "self-healing" (FIG. 15). The "self-healing" target polymers are quick-reaction time polymers that can close a rupture from a bullet slug almost as soon as the slug has passed through the polymer. Thus, the polymer target plate 16, 116 or 116A rapidly begins to close the rupture R left behind by the slug S, such that by the time the slug S completes its impact with the metal strike plate 14, the rupture R has closed and the slug S will then essentially become "trapped" in the gap 40 between the strike plate 14, 114 and the target plate 16, 116 or 116A (FIGS. 15-17). Upon hitting the metal strike plate 16, 116 and/or 116A, the slug S will generate an audible response that is unmuffled by the polymer of the target 10 or 100. Finally, the slug S will typically distort in a compacted manner upon impact with the strike plate 14 or 114, and will simply fall out of the target between the plates 14, 114 and 16, 116, 116A, as shown. As an added benefit, the configuration of the target 10 or 100 will greatly reduce, if not entirely eliminate, the potential for a ricochet bullet slug returning to injure the shooter.

While I have described in the detailed description a configuration that may be encompassed within the disclosed embodiments of this invention, numerous other alternative configurations, that would now be apparent to one of ordinary skill in the art, may be designed and constructed within the bounds of my invention as set forth in the claims. Moreover, the above-described novel self-healing targets with audible response 10 and 100 of the present invention can be arranged in a number of other and related varieties of configurations without expanding beyond the scope of our invention as set forth in the claims.

For example, it is not necessary that the entire target shell 12, 112 or 112A be constructed of "self-healing" polymer, so long as the body or shall contains a sufficient amount of self-healing polymer to enable the targeted areas to "heal". It is therefore preferred that at least the plates 16 and one of the plates 116 or 116A be constructed of a "self-healing" polymer. It is also not necessary that the separation or gap 40, 140, 140A between the metal strike plate 14, 114 and the polymer target plate 16, 116, 116A be a particular dimension, or that it must be entirely uniform, so long as there is sufficient separation between the metal plate and the polymer plates to allow a projectile to strike the metal plate after passing through the polymer so as the separation allows the projectile to create a relatively unmuffled audible response when striking the metal plate.

Likewise, it is not necessary that the targets 10, 100 have a round shape, but can be constructed in virtually any desired shape, so long as the target's polymer and metal plates have a separation that performs and provides the benefits as outlined in this disclosure.

Of course, the metal plates 14, 114, and the polymer plates 16, 116 and 116A need not be the same shape or thickness, nor be fully uniform in thickness, so long as there is sufficient separation between the metal plate and the polymer plates to allow a projectile to strike the metal plate after passing through the polymer so as to allow the projectile to create a relatively unmuffled audible response when striking the metal plate.

Further, the separation between the plates 14, 114 and 16, 116 or 116A, respectively, can be set at different distances, other than the one-half inch described above, to best suit the ammunition being used on the target 10, or for other reasons. That is, it would be preferable to have a greater distance between the plates 14, 114 and 16, 116 or 116A, respectively, for a bullet with a long slug, such as for example a rifle bullet, as opposed to a bullet with a shorter slug, such as for example a pistol bullet. For example, a single target 10 can be constructed to have two different separations between the plates 14 and 16 by merely making the slots 22 and 28 wider than the strike plate 14 such that a spacer (not shown) can be selectively placed in the slots with the plate tabs on one side or the other of the tabs 18 and 20. In this way, when the spacers are placed on one side of the plate tabs, the plates 14 and 16 will have one separation there between, and when the spacers are placed on the other side of the plate tabs, the plates 14 and 16 will have a different separation there between.

Alternately, tabs for the strike plate 14 can be offset from the plane of the strike plate 14 such that, again, two different separations between the plates 14 and 16 can be had by simply turning the strike plate 14 around. Furthermore, the tab 18 and central portion 24 of the attachment structure 20 can be configured with more than one pair of horizontal slots, where each pair of slots is positioned at a difference distance from the target plate 16 so as to create multiple gaps 40 of differing widths between the plates 14 and 16 when the strike plate 14 is positioned in a selected pair of slots.

Furthermore, the target 10 or 100 can be adapted to attach to a stand (not shown), which may for example be a vertical pole or rod, such that the target 10, 100 will move or rotate from a first position to a second position relative to the stand when a projectile impacts the target's strike zone.

Additional variations or modifications to the configuration of the above-described novel self-healing target with audible response 10, 100 of the present invention may occur to those skilled in the art upon reviewing the subject matter of this invention. Such variations, if within the spirit of this disclosure, are intended to be encompassed within the scope of this invention. The description of the embodiments as set forth herein, and as shown in the drawings, is provided for illustrative purposes only and, unless otherwise expressly set forth, is not intended to limit the scope of the claims, which set forth the metes and bounds of my invention.

What is claimed is:

1. An audible response self-healing target comprising:

a. a first body, said first body having a first strike zone comprising a self-healing polymer, said first body having an integral first attachment component and an integral second attachment component; and b. a strike plate, said strike plate having an outer edge and a first impact face positioned within said outer edge, said first impact face comprising a material capable of generating an audible response when struck by a projectile, said outer edge defining a first attachment element and a second attachment element, said first impact face being positioned substantially between said first and second attachment elements, said first impact face directed at least in part toward said first body first strike zone, said first impact face being positioned at least in part behind said first body first strike zone, said first body first attachment component attaching directly to said first attachment element, said first body second attachment component attaching to said second attachment element, said first body engaging said strike plate only at said first and second attachment elements, said first and second attachment components and said first and second attachment elements separating said first body strike zone from said first impact face to form a first gap there between when said first body is attached to said strike plate.

2. The audible response self-healing target of claim 1, wherein one of said first body first and second attachment components engages its respective said attachment element along an elongated span of said strike plate outer edge.

3. The audible response self-healing target of claim 2, wherein said elongated span is at least in part arcuate.

4. The audible response self-healing target of claim 1, wherein at least one of said first body attachment components extends radially outward from said first strike zone.

5. The audible response self-healing target of claim 1, wherein said first body strike zone comprises a first plane and one of said first body first and second attachment components extends away from said plane.

6. The audible response self-healing target of claim 1, wherein one of said first and second attachment components releasably attaches to one of said first and second attachment elements.

7. The audible response self-healing target of claim 1, wherein said first gap is substantially uniform between said first strike zone and said first impact face.

8. The audible response self-healing target of claim 1, further comprising a second body having a second strike zone, said strike plate being positioned at least in part between said first strike zone and said second strike zone, said strike plate having a second impact face generally opposite said first impact face, said second impact face directed at least in part toward said second strike zone, said second impact face being positioned at least in part behind said second strike zone, said second strike zone being separated from said strike plate by a second gap.

9. The audible response self-healing target of claim 8, wherein said second body attaches to said first and second attachment elements, said strike plate engaging said second body only at said first and second attachment elements.

10. The audible response self-healing target of claim 8, wherein said second body comprises a third attachment component, said third attachment component attaching to said first attachment element.

11. The audible self-healing target of claim 8, wherein one of said first body and said second body further comprises an attachment structure, said attachment structure attaching said one of said first body and said second body to a support structure.

12. The audible response self-healing target of claim 8, wherein one of said first and second attachment components releasably attaches to said strike plate outer edge.

13. The audible response self-healing target of claim 8, wherein said first gap is substantially uniform between said first strike zone and said first impact face.

14. An audible response self-healing target comprising:

a. a strike plate comprising a first impact face, said first impact face comprising a material capable of generating an audible response when struck by a projectile, said strike plate having an outer edge, said first impact face being positioned within said outer edge; and b. a first body, said first body having a first strike zone comprising a self-healing polymer, said first body further comprising two integral attachment components, one of said attachment components attaching directly to said strike plate outer edge, said first body engaging said strike plate only along said outer edge, at least one of said attachment components extending radially outward from said first strike zone, said first strike zone being positioned at least in part in front of said strike plate first impact face, said first strike zone being separated from said first impact face by a first gap.

15. The audible response self-healing target of claim 14, wherein one of said attachment components engages said strike plate outer edge along an elongated span of said outer edge.

16. The audible response self-healing target of claim 15, wherein said elongated span is at least in part arcuate.

17. The audible response self-healing target of claim 14, wherein said strike plate outer edge defines an attachment element, said attachment element attaching to one of said first body first and second attachment components.

18. The audible response self-healing target of claim 14, further comprising a second body having a second strike zone, said strike plate being positioned at least in part between said first body first strike zone and said second body second strike zone, said second strike zone being separated from said strike plate by a second gap.

19. The audible response self-healing target of claim 18, wherein said second strike zone comprises a self-healing polymer, said second body having a first attachment component and a second attachment component separated from said first attachment component, said first and second attachment components each being sized to attach at least a portion of said second body to said strike plate outer edge, said second body engaging said strike plate only at said outer edge.

20. The audible response self-healing target of claim 19, wherein said strike plate outer edge defines a first attachment element and a second attachment element, said second body first and second attachment components attaching to said first and second attachment elements.

* * * * *